US011043744B2

(12) United States Patent
Yang

(10) Patent No.: US 11,043,744 B2
(45) Date of Patent: Jun. 22, 2021

(54) ANTENNA OSCILLATOR AND PLANAR ANTENNA

(71) Applicant: SHENZHEN ANTOP TECHNOLOGY CO., LTD., Shenzhen (CN)

(72) Inventor: Ruidian Yang, Shenzhen (CN)

(73) Assignee: Shenzhen Antop Technology Co., LTD., Shenzhen (CN)

( * ) Notice: Subject to any disclaimer, the term of this patent is extended or adjusted under 35 U.S.C. 154(b) by 70 days.

(21) Appl. No.: 16/679,088

(22) Filed: Nov. 8, 2019

(65) Prior Publication Data

US 2021/0091468 A1 Mar. 25, 2021

(30) Foreign Application Priority Data

Sep. 23, 2019 (CN) ..... 201921600215.1

(51) Int. Cl.
*H01Q 1/00* (2006.01)
*H01Q 5/335* (2015.01)
*H01Q 9/04* (2006.01)

(52) U.S. Cl.
CPC ..... *H01Q 5/335* (2015.01); *H01Q 9/0407* (2013.01)

(58) Field of Classification Search
CPC ..... H01Q 5/335; H01Q 9/0407
USPC ..... 343/904
See application file for complete search history.

(56) References Cited

U.S. PATENT DOCUMENTS 4,275,369 A * 6/1981 Sekiguchi ..... H01P 1/2053 333/209
4,736,454 A * 4/1988 Hirsch ..... H01Q 1/247 331/107 R
5,450,091 A * 9/1995 Hama ..... H01Q 1/273 343/718
6,414,639 B1 * 7/2002 Iio ..... H01P 7/10 333/126
8,723,745 B2 * 5/2014 Amari ..... H01Q 9/0421 343/750
8,773,317 B2 * 7/2014 Sakata ..... H01Q 1/521 343/722
2003/0117244 A1 * 6/2003 Matsuura ..... H01P 1/2086 333/219
2011/0187615 A1 * 8/2011 Sakata ..... H01Q 9/40 343/722
2011/0254749 A1 * 10/2011 Amari ..... H01Q 9/0421 343/750
2013/0328635 A1 * 12/2013 Sekiguchi ..... H03B 7/14 331/105
2018/0233810 A1 * 8/2018 Sun ..... H01Q 9/42

* cited by examiner

*Primary Examiner* — Jean B Jeanglaude
(74) *Attorney, Agent, or Firm* — Robert L. Stearns; Dickinson Wright, PLLC

(57) ABSTRACT

Antenna technology includes an antenna oscillator and a planar antenna. The antenna oscillator has a plate-like structure and includes a first resonance part and a second resonance part connected to the first resonance part. The first resonance part and the second resonance part are provided with a first resonance window and a second resonance window, respectively. The first resonance window and the second resonance window have different effective sizes and the antenna oscillator is further provided with a connecting slit.

18 Claims, 4 Drawing Sheets

ANTENNA OSCILLATOR AND PLANAR ANTENNA

CROSS REFERENCE TO RELATED APPLICATION

This application claims priority to Chinese Patent Application No. CN201921600215.1 filed on filed on Sep. 23, 2019, the entire disclosure of which is incorporated herein by reference in its entirety.

TECHNICAL FIELD

The disclosure relates to the field of antenna technology, in particular, to an antenna oscillator and a planar antenna.

BACKGROUND

The technology of planar antennas is becoming mature. Due to its small size, light weight, small wind resistance and convenient installation and use, the planar antenna based on the flaky antenna oscillator is widely used in many fields. As the planar antenna is more efficient, it is especially suitable for the reception of live satellite TV signals, which is very popular among consumers.

With the popularity of digital TV, consumers have raised higher requirements for the design of wireless band antenna for digital TV. Traditional antenna oscillators have defects in both the effective bandwidth that can be achieved and the stability of signal reception.

SUMMARY

The purpose of the disclosure is to provide an antenna oscillator, which aims to solve the technical problem that the traditional antenna oscillator has a small effective bandwidth range and poor signal stability.

The present disclosure is realized by the antenna oscillator, which has a plate-like structure, including a first resonance part and a second resonance part. The first resonance part and the second resonance part are provided with a first resonance window and a second resonance window, respectively. The first resonance window has a different effective size from the second resonance window, the antenna oscillator is further provided with a connecting slit, and the connecting slit is connected to the first resonance window and the second resonance window. Both sides of the connecting slit are provided with a feed port.

In an embodiment of the disclosure, the shape of the first resonance window is adapted to the shape of the first resonance part and the shape of the second resonance window is adapted to the shape of the second resonance part.

In an embodiment of the present disclosure, the first resonance part includes a vertical plate, a first horizontal plate, a second horizontal plate, a first slanting plate and a second slanting plate; the first horizontal plate and the second horizontal plate are connected to an upper end and a lower end of the same side of the vertical plate, respectively; the first slanting plate and the second slanting plate are connected to the first horizontal plate and the second horizontal plate, respectively; the first slanting plate and the second slanting plate extend toward each other and the end thereof is connected to the second resonance part; the second resonance part has a rectangular shape, the second resonance window has an elongated rectangular shape; the connecting slit is connected to a middle portion of a long side of the rectangular structure of the second resonance window and the first resonance window; the antenna oscillator has a symmetrical structure.

In an embodiment of the disclosure, the antenna oscillator is further provided with a mounting hole.

In an embodiment of the disclosure, the first resonance part and the second resonance part are made in one piece by a metal material.

In an embodiment of the disclosure, the antenna oscillator is made of aluminum or iron.

The present disclosure also provides a planar antenna, including a first antenna oscillator and a second antenna oscillator, wherein the first antenna oscillator and the second antenna oscillator are respectively the antenna oscillator as described above. The planar antenna further comprises a connector. The feed ports of the first antenna oscillator and the second antenna oscillator are configured for feed connection through the connector.

In an embodiment of the present disclosure, the first antenna oscillator and the second antenna oscillator are at the same plane and the second resonance part of the first antenna oscillator extends toward the second resonance part of the second antenna oscillator. The connector includes a first connector and a second connector, symmetrically arranged in parallel. The first connector is connected to one feed port of the first antenna oscillator and one feed port of the second antenna oscillator; the second connector is connected to another feed port of the first antenna oscillator and another feed port of the second antenna oscillator.

In an embodiment of the present disclosure, the first connector and the second connector are each in a strip-like structure, wherein the middle portion is provided with an impedance tuning structure.

In an embodiment of the present disclosure, the first connector and the second connector are each provided with a fixing hole for fixing the spacing distance between the first connector and the second connector.

An antenna oscillator and a planar antenna of the present disclosure have at least the following beneficial effects:

the first resonance window and the second resonance window having different effective sizes are provided in the first resonance part and the second resonance part connected to each other and the connecting slit is connected to the first resonance window and the second resonance window, so that the antenna oscillator can resonate at two different frequency points and thereby expand the effective bandwidth of the antenna oscillator. Furthermore, the antenna oscillator has better responsiveness to each frequency in the effective bandwidth and improves the stability when receiving and transmitting various frequency signals within the effective bandwidth.

BRIEF DESCRIPTION OF THE DRAWINGS

In order to illustrate the technical protocols in the embodiments of the present disclosure more clearly, the drawings used in the embodiments will be briefly described below. It is obvious that the drawings in the following description are only some embodiments of the present disclosure. To an ordinary person in this art, other drawings may also be obtained based on these drawings before they devote inventive work.

Figure 1:
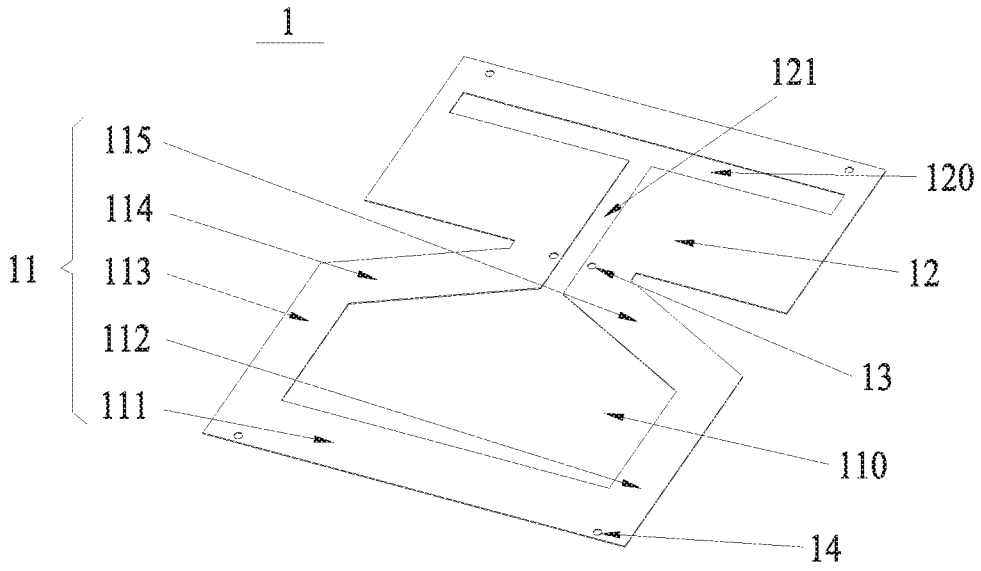
FIG. 1 shows a schematic structural diagram of an antenna oscillator according to an embodiment of the present disclosure.

The references in the above figures are as follows in detail:

1—antenna oscillator; 101—the first antenna oscillator; 102—the second antenna oscillator; 11—the first resonance part; 110—the first resonance window; 111—vertical plate; 112—the first horizontal plate; 113—the second horizontal Plate; 114—the second slanting plate; 115—the first slanting plate; 12—the second resonance portion; 120—the second resonance window; 121—connecting slit; 13—feed port; 14—mounting hole; 2—connector; 201—the first connector; 202—the second connector; 21—impedance tuning structure; 22—fixing hole.

DETAILED DESCRIPTION OF THE EMBODIMENTS

In order to make the objects, technical protocols and advantages of the present disclosure more comprehensible, the present disclosure will be further described in detail below with reference to the accompanying drawings and embodiments. It is understood that the specific embodiments described herein are merely illustrative of the disclosure and are not intended to limit the disclosure.

It should be noted that when a component is referred to as being "fixed" or "provided" to another component, it can be directly or indirectly located on the "another component". When a component is referred to as being "connected" to another component, it can be directly or indirectly connected to the other component. The terms "up", "down", "left", "right", "front", "back", "vertical", "horizontal", "top", "bottom", "inside", "outside", etc. indicate that the orientation or position is based on the orientation or position shown in the drawings and is merely for convenience of description but not to be construed as technical protocols limitation. The terms "first" and "second" are used for convenience of description only and are not to be understood as indicating or implying a relative importance or implicitly indicating the number of technical features. "A plurality of" means two or more, unless specifically defined otherwise.

In order to explain the technical protocols of the present disclosure, the following detailed description will be made in connection with the specific drawings and embodiments.

According to FIG. 1, an embodiment of the present disclosure provides an antenna oscillator 1 having a plate-like structure, which includes a first resonance part 11 and a second resonance part 12 connected to the first resonance part 11. The first resonance part 11 and the second resonance part 12 are provided with a first resonance window 110 and a second resonance window 120, respectively. The first resonance window 110 has different effective size from the second resonance window 120. The antenna oscillator 1 is further provided with a connecting slit 121 for connection. The connecting slit 121 is connected to the first resonance window 110 and the second resonance window 120 and both sides of the connecting slit 121 are provided with a feed port 13.

The first resonance window and the second resonance window having different effective sizes are provided in the first resonance part and the second resonance part which are connected to each other and the first resonance window and the second resonance window are connected through the connecting slit. By this means, the antenna oscillator 1 provided by the embodiment of the present disclosure render the antenna oscillator resonate at two different frequency points, thereby expanding the effective bandwidth of the antenna oscillator. Furthermore, the antenna oscillator has better responsiveness to each frequency in the effective bandwidth and it improves the stability when receiving and transmitting various frequency signals within the effective bandwidth.

In an embodiment of the present disclosure according to FIG. 1, the shape of the first resonance window 110 is adapted to the shape of the first resonance part 11 and the shape of the second resonance window 120 is adapted to the shape of the second resonance part 12. Such settings can improve the anti-deformation ability of the antenna oscillator and avoid deformation caused by an external force to affect its normal performance.

In an embodiment of the present disclosure according to FIG. 1, the first resonance part 11 includes a vertical plate 111, the first horizontal plate 112 and the second horizontal plate 113 are connected to an upper end and a lower end of the same side of the vertical plate 111, respectively. The first slanting plate 115 and the second slanting plate 114 are connected to the first horizontal plate 112 and the second horizontal plate 113, respectively. The first slanting plate 115 and the second slanting plate 114 extend toward each other and the end thereof is connected to the second resonance part 12; the second resonance part 12 has a rectangular shape, the second resonance window 120 has an elongated rectangular shape and the connecting slit 121 is connected to a middle portion of a long side of the rectangular structure of the second resonance window 120 and the first resonance window 110. The antenna oscillator 1 has a symmetrical structure.

The first resonance window 110 has a pentagonal structure in which a rectangular shape and an isosceles triangle are spliced and the second resonance window 120 has a rectangular structure. The effective dimensions of the first resonance window 110 and the second resonance window 120 are different. Resonance occurs at two different frequencies, thereby expanding the effective bandwidth; the impedance of the antenna oscillator 1 is adjusted by changing the width of the second resonance window 120; the antenna oscillator 1 has a symmetrical structure as a whole, which makes the antenna oscillator 1 more aesthetically beautiful, and easier to manufacture. In the assembly process, it is not necessary to distinguish the upper and lower sides of the antenna oscillator 1. Even if the antenna oscillator 1 is turned upside down and installed, the function of transmitting and receiving signals can be realized, thereby simplifying the assembly work of the antenna device.

In an embodiment of the present disclosure according to FIG. 1, the antenna oscillator 1 has a thickness of 0.4-0.5 mm, the first horizontal plate 112 is spaced apart from the second horizontal plate 113 by 140-150 mm, the vertical plate 111 is separated from the joint of the first slanting plate 115 and the first horizontal plate 112 by 50-60 mm and separated from the end of the first slanting plate 115 by 90-100 mm, the connecting slit 121 has a length of 75-80 mm and a width of 10-15 mm. The second resonance window 120 has a length of 160-170 mm and a width of 10-15 mm.

Figure 2:
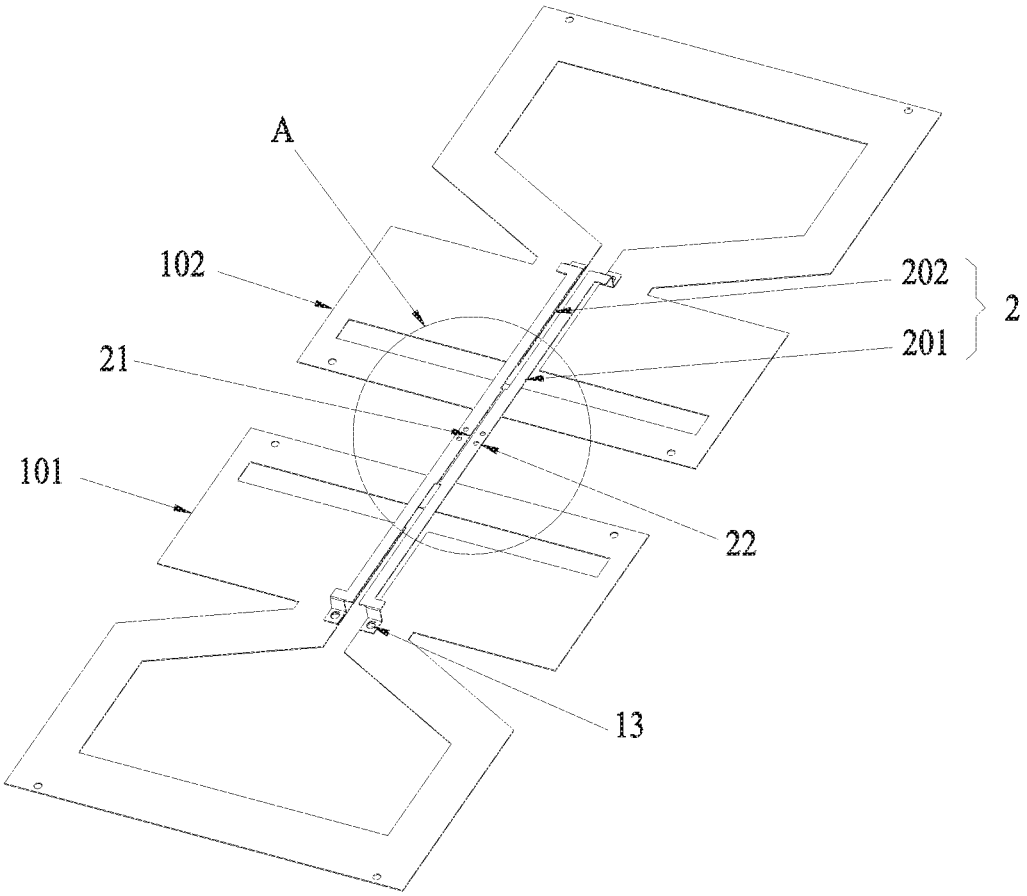
FIG. 2 shows a schematic structural diagram of a planar antenna according to an embodiment of the present disclosure.
Figure 4:
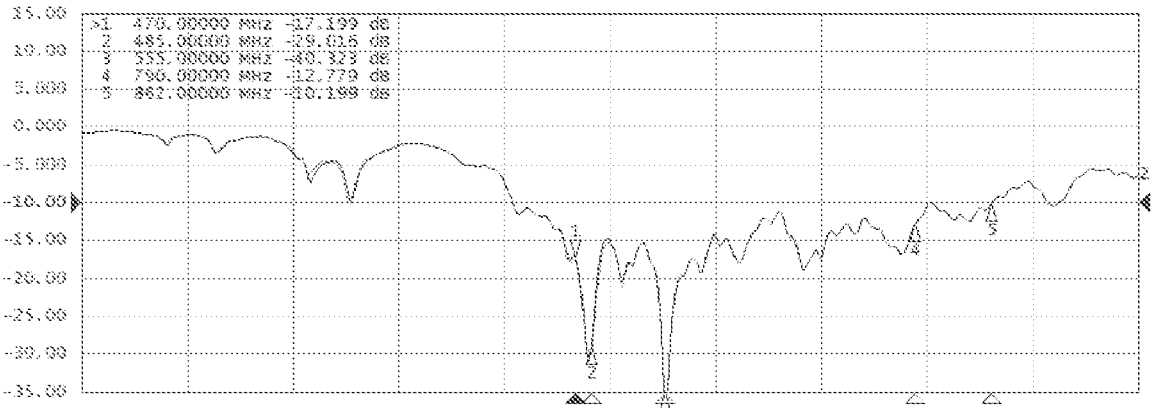
FIG. 4 shows a diagram of a reflection loss of a planar antenna according to an embodiment of the present disclosure.
Figure 5:
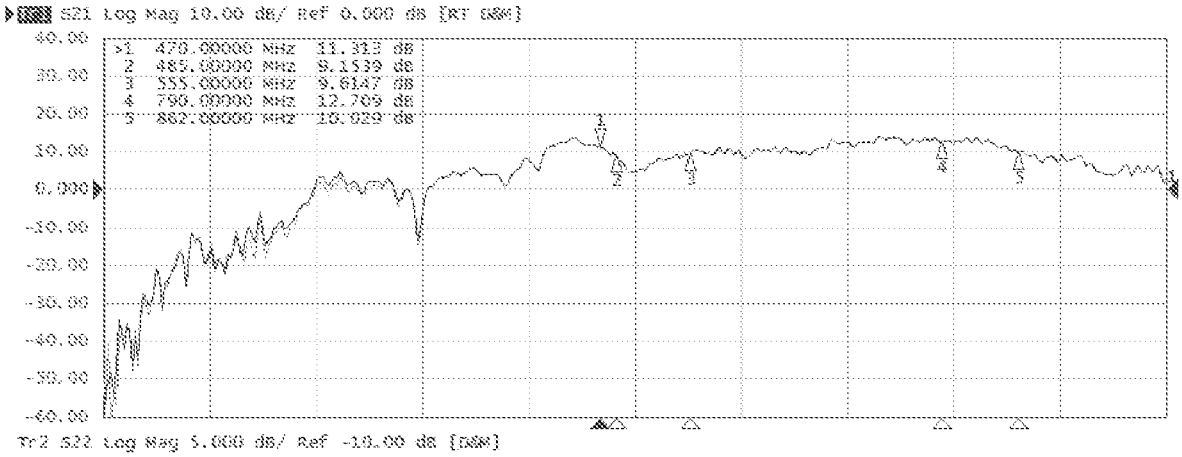
FIG. 5 shows a diagram of gain test result of a planar antenna according to an embodiment of the present disclosure.

As a specific embodiment of the present disclosure according to FIG. 1, the antenna oscillator 1 has thickness of 0.5 mm, the first horizontal plate 112 and the second horizontal plate 113 are spaced by 146 mm, the vertical plate 111 is spaced from the joint of the first slanting plate 115 and the first horizontal plate 112 by 57.92 mm and spaced from the end of the first slanting plate 115 by 91.5 mm, the connecting slit 121 has a length of 76 mm and a width of 10 mm, the second resonance window 120 a length of 170 mm and a width of 12 mm. Two antenna oscillators 1 as described above are arranged oppositely, and a wide range of effective bandwidth can be obtained after the feed ports 13 are configured for feed connection through the connector 2. Preferably, the impedance of the connector 2 in the present embodiment is close to 75Ω. Referring to FIG. 2, FIG. 4 and FIG. 5, the reflection loss curve of the planar antenna of FIG. 2 is shown in FIG. 4. It can be seen that the planar antenna can resonate in the frequency bands of 485 Mhz and 555 Mhz and the output impedance of the antenna has good matching with the output coaxial line impedance and has a high antenna efficiency. The gain test results of the planar antenna at each frequency are shown in FIG. 5. It can be seen that the antenna oscillator 1 has a wide range of effective bandwidth and the gain waveform is flat. The frequency bandwidth received by the antenna is wide and stable. The excellent gain index can be achieved at each frequency in the ultra-high frequency band.

In an embodiment of the present disclosure according to FIG. 1, the antenna oscillator 1 is further provided with a mounting hole 14 for mounting the antenna oscillator 1 on the outer housing or the substrate to prevent the antenna oscillator 1 from being deformed by force and can maintain the inherent shape of the antenna oscillator 1, thus avoids the influence on its performance and normal use by the deformation of the antenna oscillator 1 under external force.

In an embodiment of the present disclosure, the first resonance part 11 and the second resonance part 12 are made in one piece by a metal material, such as aluminum or iron, which ensures the resonance performance of the antenna oscillator 1, enhances the structural strength of the antenna oscillator 1 and reduces the manufacturing cost of the antenna oscillator 1. As a preferred embodiment of the disclosure, the antenna oscillator 1 may be made of tinplate.

In an embodiment of the present disclosure according to FIG. 2, the planar antenna includes a first antenna oscillator 101 and a second antenna oscillator 102. The first antenna oscillator 101 and the second antenna oscillator 102 are as described above for the antenna oscillator 1. The planar antenna also includes a connector 2 through which the feed ports 13 of the first antenna oscillator 101 and the second antenna oscillator 102 are configured for feed connection.

In an embodiment of the present disclosure according to FIG. 2, the first antenna oscillator 101 and the second antenna oscillator 102 are in the same plane, the second resonance part 12 of the first antenna oscillator 101 extend toward the second resonance part 12 of the second antenna oscillator 102, the connector 2 includes a first connector 201 and a second connector 202 which are symmetrically arranged in parallel, the first antenna oscillator 101 and the second antenna oscillator 102 are provided with a feed port 13 on each side of the connecting slit 121 thereof, respectively. The first connector 201 is connected to one feed port 13 of the first antenna oscillator 101 and one feed port 13 on the same side of the second antenna oscillator 102, the second connector 202 is connected to another feed port 13 of the first antenna oscillator 101 and another feed port 13 of the second antenna oscillator 102. As such the first antenna oscillator 101 and the second antenna oscillator 102 form a symmetric oscillator antenna, the first connector 201 and the second connector 202 are placed in parallel and close to each other. The middle position of symmetric antenna oscillator is the signal output feeding point which guides the received signal to the amplifier or directly transmits the received signal to the user terminal.

Figure 3:
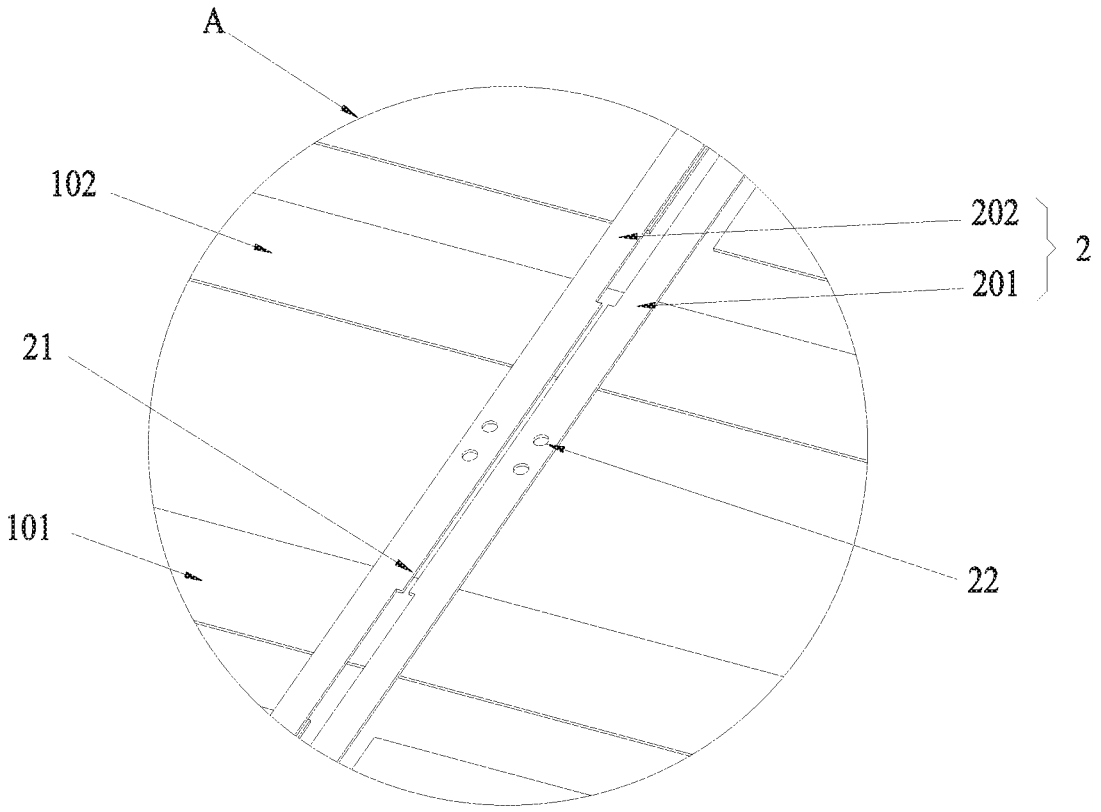
FIG. 3 shows a partial enlarged diagram of the portion A of FIG. 2.

In an embodiment of the present disclosure according to FIG. 3, the first connector 201 and the second connector 202 are each in a strip-like structure and wherein the middle portion is provided with an impedance tuning structure 21. The spacing between the first connector 201 and the second connector 202 directly affects the coupling capacitance of the feed. The size of the coupling capacitor affects the output impedance of the antenna. Therefore, the spacing of the first connector 201 and the first connector 201 can be adjusted by setting the impedance tuning structure 21, thereby the coupling capacitance is changed. Furthermore, tune the output reflection index of the planar antenna finely, so that the output impedance of the planar antenna is as close as possible to 75Ω or 50Ω.

In an embodiment of the present disclosure according to FIG. 3, the first connector 201 and the second connector 202 are both provided with fixing hole 22 for fixing the spacing distance of the first connector 201 and the second connector 202. In order to prevent the spacing of the first connector 201 and the second connector 202 from changing under the action of its own gravity or external force, thereby affecting the coupling capacitance of the feed and the output impedance of the antenna, in this embodiment, the middle position of the connector 2 is provided with a fixing hole 22 for further reinforcing the structure of the planar antenna. Furthermore, the planar antenna can be fixed on the supporting structure through the fixing hole 22, or the distance of the first connector 201 and the second connector 202 can be fixed only by one fixing structure.

It should be noted that the antenna oscillator 1 and the planar antenna according to the embodiments of the present disclosure can be applied to a television signal receiving antenna. In particular, the antenna oscillator 1 and the planar antenna according to the embodiments of the present disclosure have a better gain and reflection performance in the Ultra high frequency full band, which can be applied to digital TV signal receiving antennas.

The above is only an alternative embodiment of the present disclosure, and is not intended to limit the present disclosure. Any modifications, equivalent replacements or/and improvements made within the spirit and principles of the present disclosure should be included in the protection scope of the present disclosure.

What is claimed is:

1. An antenna oscillator, wherein the antenna oscillator has a plate-like structure and comprises a first resonance part and a second resonance part connected to the first resonance part; the first resonance part and the second resonance part are provided with a first resonance window and a second resonance window, respectively; the first resonance window has a different effective size from the second resonance window; the antenna oscillator is further provided with a connecting slit which connects the first resonance window with the second resonance window, wherein both sides of the connecting slit are each provided with a feed port.

2. The antenna oscillator according to claim 1, wherein the shape of the first resonance window is adapted to the shape of the first resonance part and the shape of the second resonance window is adapted to the shape of the second resonance part.

3. The antenna oscillator according to claim 2, wherein the first resonance part comprises a vertical plate, a first horizontal plate, a second horizontal plate, a first slanting plate and a second slanting plate; the first horizontal plate and the second horizontal plate are connected to an upper end and a lower end of the same side of the vertical plate, respectively; the first slanting plate and the second slanting plate are connected to the first horizontal plate and the second horizontal plate, respectively; the first slanting plate and the second slanting plate extend toward each other and ends of the first slanting plate and the second slanting plate are connected to the second resonance part; the second resonance part has a rectangular shape, and the second resonance window has an elongated rectangular shape; the connecting slit is connected to a middle portion of a longer side of a rectangular structure of the second resonance window and the first resonance window; the antenna oscillator has a symmetrical structure.

4. The antenna oscillator according to claim 1, wherein the antenna oscillator is further provided with a mounting hole.

5. The antenna oscillator according to claim 1, wherein the first resonance part and the second resonance part are made in one piece by a metal material.

6. The antenna oscillator according to claim 5, wherein the antenna oscillator is made of aluminum or iron.

7. A planar antenna, wherein the planar antenna comprises a first antenna oscillator and a second antenna oscillator, wherein the first antenna oscillator and the second antenna oscillator are respectively the antenna oscillator according to claim 1; the planar antenna further comprises a connector, and the feed ports of the first antenna oscillator and the second antenna oscillator are configured for feed connection through the connector.

8. The planar antenna according to claim 7, wherein the first antenna oscillator and the second antenna oscillator are at the same plane, and the second resonance part of the first antenna oscillator is directly opposite to the second resonance part of the second antenna oscillator; the connector comprises a first connector and a second connector, symmetrically arranged in parallel; the first connector is connected to one feed port of the first antenna oscillator and one feed port of the second antenna oscillator; and the second connector is connected to another feed port of the first antenna oscillator and another feed port of the second antenna oscillator.

9. The planar antenna according to claim 8, wherein the first connector and the second connector are each in a strip-like structure, and a section between the first connector and the second connector is provided with an impedance tuning structure.

10. The planar antenna according to claim 8, wherein the first connector and the second connector are each provided with a fixing hole for fixing spacing distance between the first connector and the second connector.

11. The antenna oscillator according to claim 2, wherein the first resonance part and the second resonance part are made in one piece by a metal material.

12. The antenna oscillator according to claim 3, wherein the first resonance part and the second resonance part are made in one piece by a metal material.

13. The antenna oscillator according to claim 4, wherein the first resonance part and the second resonance part are made in one piece by a metal material.

14. The planar antenna according to claim 7, wherein, for each of the first antenna oscillator and the second antenna oscillator, the shape of the first resonance window is adapted to the shape of the first resonance part and the shape of the second resonance window is adapted to the shape of the second resonance part.

15. The planar antenna according to claim 14, wherein, for each of the first antenna oscillator and the second antenna oscillator, the first resonance part comprises a vertical plate, a first horizontal plate, a second horizontal plate, a first slanting plate and a second slanting plate; the first horizontal plate and the second horizontal plate are connected to an upper end and a lower end of the same side of the vertical plate, respectively; the first slanting plate and the second slanting plate are connected to the first horizontal plate and the second horizontal plate, respectively; the first slanting plate and the second slanting plate extend toward each other and ends of the first slanting plate and the second slanting plate are connected to the second resonance part; the second resonance part has a rectangular shape, and the second resonance window has an elongated rectangular shape; the connecting slit is connected to a middle portion of a longer side of a rectangular structure of the second resonance window and the first resonance window; the antenna oscillator has a symmetrical structure.

16. The planar antenna according to claim 7, wherein each of the first antenna oscillator and the second antenna oscillator is further provided with a mounting hole.

17. The planar antenna according to claim 7, wherein the first resonance part and the second resonance part are made in one piece by a metal material for each of the first antenna oscillator and the second antenna oscillator.

18. The planar antenna according to claim 17, wherein each of the first antenna oscillator and the second antenna oscillator is made of aluminum or iron.

* * * * *